US005465744A

United States Patent [19]

Browning

[11] Patent Number: 5,465,744

[45] **Date of Patent: * Nov. 14, 1995**

[54] MOBILITY ASSIST DEVICE

[75] Inventor: U. Grant Browning, Nashville, Tenn.

[73] Assignee: My Independence, Inc., Nashville, Tenn.

[ * ] Notice: The portion of the term of this patent subsequent to Apr. 26, 2011, has been disclaimed.

[21] Appl. No.: 210,007

[22] Filed: Mar. 17, 1994

Related U.S. Application Data

[63] Continuation-in-part of Ser. No. 883,134, May 13, 1992, Pat. No. 5,305,773.

[51] Int. Cl.[6] ..... A61G 7/10; A61H 3/00

[52] U.S. Cl. ..... 135/67; 135/71; 135/72; 5/81.1

[58] Field of Search ..... 135/67, 71, 72, 135/65; 5/81.1, 84.1, 662

[56] References Cited

U.S. PATENT DOCUMENTS

| | | |
|---|---|---|
| 3,085,258 | 4/1963 | Wolferts . |
| 3,232,251 | 2/1966 | Hughes . |
| 3,553,746 | 1/1971 | Seiger . |
| 3,739,793 | 6/1973 | Wilson . |
| 3,945,389 | 3/1976 | Smith . |
| 4,212,493 | 7/1980 | Ledesky . |
| 4,314,576 | 2/1982 | McGue . |
| 4,411,283 | 10/1983 | Lucarelli . |
| 4,452,484 | 6/1984 | Pastor . |
| 4,474,202 | 10/1984 | Blechner . |
| 4,640,301 | 2/1987 | Battiston et al. . |
| 4,843,661 | 7/1989 | Skibinski . |
| 4,894,871 | 1/1990 | Schmerler . |
| 5,005,599 | 4/1991 | Cunningham . |
| 5,058,912 | 10/1991 | Harroun . |

FOREIGN PATENT DOCUMENTS

| | | |
|---|---|---|
| 2274274 | 6/1974 | France . |

*Primary Examiner*—Wynn E. Wood

*Attorney, Agent, or Firm*—Mark J. Patterson; Waddey & Patterson

[57] ABSTRACT

In the present invention, an adjustable mobility assist device is provided which has a base, means for obtaining leverage against a stationary object, and grasping means which allow the user to reach out and up while rising from a seated position. In its several embodiments, the device can be adapted for use in rising from a chair, bed, or commode. Handles are provided so that the device can also assist in walking. Arms are also included for supporting the users arms, a reading or eating tray, and the like. The device is portable and can be moved from one piece of furniture to another within the home with the user.

18 Claims, 11 Drawing Sheets

MOBILITY ASSIST DEVICE

This is a continuation-in-part application of co-pending U.S. application Ser. No. 883,134 filed May 13, 1992.

BACKGROUND OF THE INVENTION

The present invention relates generally to a device for assisting a individual in rising from a bed, chair or commode, and more particularly to a device which cooperates with the ground, the wall, and/or another stationary workpiece to enable an individual to rise from a reclining or seated position and, in some cases, assist the user in walking.

It will be appreciated by those skilled in the art that certain elderly or infirm individuals have difficultly in rising and walking without assistance. It will be further appreciated by those skilled in the art that many of these individuals desire to be able to rise or walk without the assistance of another or without the assistance of a wheelchair or hoist. To this end, there have been several attempts to provide an individual with a mechanism to either rise from a seated position or walk.

A combined bed-tray, table, and walker is disclosed in U.S. Pat. No. 3,232,251 issued to W. P. Hughes on Feb. 1, 1966. Unfortunately, the Hughes patent requires an individual to push downwardly to rise from a seated position. The base of Hughes is not broad enough to allow an individual to pull himself or herself up from a seated position. Hughes does not cooperate with the workpiece from which the person rises. Also, Hughes fails to provide an easy method of adjustment.

U.S. Pat. No. 5,005,599 issued to T. Cunningham issues on Apr. 9, 1991, has many of the same problems as Hughes. Cunningham does not provide the broad base which allows a person to pull himself or herself up. Instead, the user must push up. This is difficult in elderly patients who may not be able to stand to the level high enough to push up.

U.S. Pat. No. 5,058,912 issued to M. Harroun on Oct. 22, 1991, has many of the problems of Cunningham. Instead, the user must push up. The base is not broad enough to cooperate with the floor to provide sufficient leverage. Further, the device can only be used with the chair that is attached to the walker.

U.S. Pat. No. 3,085,258 issued to M. Wolferts on Apr. 16, 1963, does not provided a base which is sufficiently deep enough to provide leverage to allow the user to pull up. Further, the device does not appear to be easily adjustable.

U.S. Pat. No. 4,314,576 issued to C. McGee on Feb. 9, 1982, fails to provide the broad base necessary to allow an individual to pull up. Instead, the individual must push up.

U.S. Pat. No. 3,739,793 issued to A. Wilson on Jun. 19, 1973, fails to recognize the need to allow an individual to pull up as opposed to push up.

U.S. Pat. No. 3,553,746 issued to H. Seiger on Jan. 12, 1971, fails to provide a mechanism which allows the individual to use the device as a walker.

What is needed, then, is a portable device which enables a user to pull, as opposed to push, up from a seated position. This needed device must be adaptable to and obtain leverage from variety of objects found in the home from which a person might rise from a seated position. Further, this device should be easily adjustable and be useful as a walker as well. This device should also contain a clearance section along the base to clear hazards such as objects, thresholds, and the like. This device is presently lacking in the prior art.

SUMMARY OF THE INVENTION

In the present device, several embodiments of a mobility assist device are presented, each of which include a base, a means for obtaining leverage against various stationary object, and a means for grasping the device such that the user can pull up and out from a chair, bed, or commode. Arms are provided for supporting a reading/eating tray.

A first embodiment of the device can be used for rising from a chair or sofa, and as a walker, with an angle brace providing support for vertical uprights and functioning as a means to obtain leverage against and maintain distance from the chair, sofa or the like. The uprights serve as a means for the user to grasp and pull up and out from a seated position to a standing position. Adjustable handles are provided for use as a walker.

A second embodiment of the device can be adapted for use as an assist in rising from a chair, bed, or commode, and as a walker. Rectangular braces provide leverage when rising from a chair and removable hooks engage and provide leverage against a bed frame. Further, the device of this embodiment can be rotated and adjusted for use as an assist in rising from a commode.

A third embodiment of the present invention, also used for rising from a chair or as a walker, has a folding hinged base and adjustable uprights with handles two more uprights joined by a third crosspiece are provided at the rear of the base which can pass over and around a workpiece such as a toilet. This enables a user to pull him or herself up from a seated position on a toilet.

A fourth embodiment is specifically adapted for use in conjunction with a commode, with leverage obtained from a wall behind the commode, without any attachment to either the commode or wall.

In the preferred embodiment, the base is elongated but also has a clearance section which does not make contact with the ground. This enables the user to avoid hazards such as objects, thresholds, and the like.

Accordingly, one object of the present invention is to provide a mobility assist device which can be safely used for rising from a variety of stationary objects found in the home.

Still another object of the present invention is to provide a device which can allow an individual to pull up and out in order to rise from a seated position rather than push up.

Still another object of the present invention is to provide a device which is easily adaptable to the size and strength limitations of a variety of potential users.

Still another object of the present invention is to provide a device which combines in a single unit a number of features needed by a mobility impaired person in the home.

Another object of the present invention is to provide a mobility assist device which has a base having a clearance to clear or navigate over hazards such as objects, thresholds, and the like.

Another object of the present invention is to provide a stable base which can interact with workpieces while still providing clearance for hazards.

Another object of the present invention is to assist the user walking in either direction.

DETAILED DESCRIPTION OF THE PREFERRED EMBODIMENTS

As will be described in detail below, the mobility assist device of the present invention generally includes a base structure, means for obtaining secure leverage through the device against the floor and a chair, bed, commode, or other workpiece, without permanent attachment to the workpiece, and means for allowing the user to grasp the device and pull up from and away from seated position on or near the workpiece.

Figure 1:
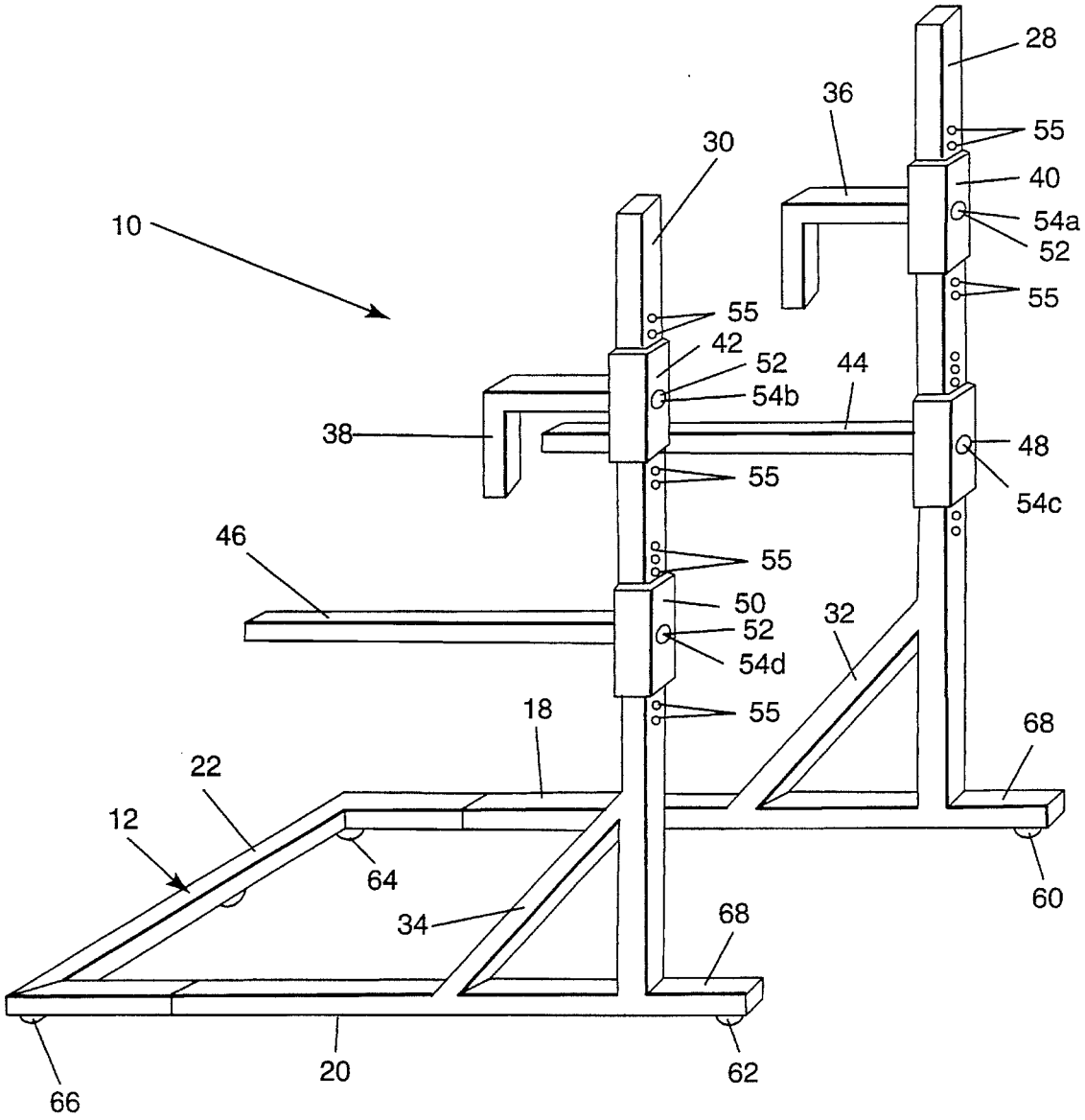
FIG. 1 is a perspective view of a first embodiment of the present invention usable for rising from a chair or as a walker.

Referring now to FIG. 1, there is shown generally at 10 a first embodiment of the mobility assist device which can be used both for rising from a chair or similar workpiece, and as a walker. The device includes a base 12, which has adjustable rear floor bar 22 joining parallel side floor bars 18 and 20. Casters 60, 62, 64, and 66 attach to the underside of base 12.

Attached to and extending vertically from side bars 18 and 20 are first upright 28 and second upright 30. Preferably, uprights 28 and 30 are joined to side bars 18 and 20 such as to define segments 68 of side bars 18 and 20 forward of uprights 18 and 20. Segments 68, which can be 4" or so in length, provide additional balance for the device and user and protection against forward tipping when the device is used as a walker.

Angled leverage braces 32 and 34 provide additional support for first upright 28 and second upright 30 and, as can be seen more clearly in FIG. 2, cooperate with rear bar 22 and side bars 18 and 20 as a means for obtaining secure leverage against the floor and a stationary workpiece (108 in FIGS. 3–4), as well as assuring proper spacing between the device 10 and the workpiece.

The device 10 also includes adjustable means for the user to grasp the device and walk from a standing position. These means include handles 36 and 38 which are attached to sleeves 40 and 42. First sleeve 40 slidably receives first upright 28 and second sleeve 42 receives second upright 30. Sleeves 40, 42 have holes 54*a* and 54*b* and uprights 28, 30 have holes 55. Holes 54*a*, 54*b* and 55 receive set screws 52 which releasably hold sleeves 40, 42 in place. Preferably, the position of sleeves 40 and 42 along uprights 28 and 30 is adjusted so that the user may reach outwardly and above handles 36 and 38 along uprights 28 and 30 and use the uprights as a means for pulling from a seated position.

Device 10 also includes adjustable tray rack arms 44 and 46 attached to sleeves 48 and 50 respectively. Sleeves 48, 50 receive uprights 28, 30 respectively, and are attached to uprights 28, 30 respectively by set screws 52 which pass through holes 54*c* and *d* into holes 55. The adjustable connection using screws 52 allows sleeves 40, 42, 48, 50 to be adjustable up and down along uprights 28 and 30. Further, because of weight placed on sleeves 40, 42 by handles 36, 38 and weight on sleeves 48, 50 by rack arms 44, 46, the downward angular pressure causes sleeves 40, 42, 48, 50 to remain in place without use of screws in certain instances thereby removing the need to have holes 54, 55. Also, rack arms 44 and 46 can be used as a means to support the users arms.

Figure 2A:
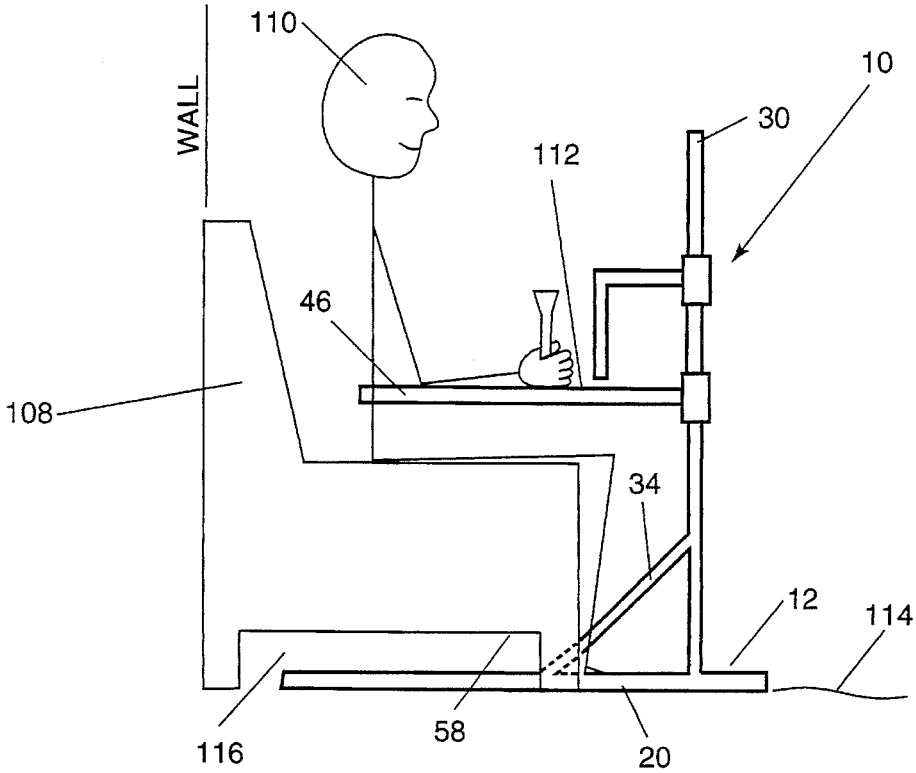
FIGS. 2*a* and *b* are side views of the chair riser/walker embodiment of FIG. 1 showing the user seated in a chair.
Figure 2B:
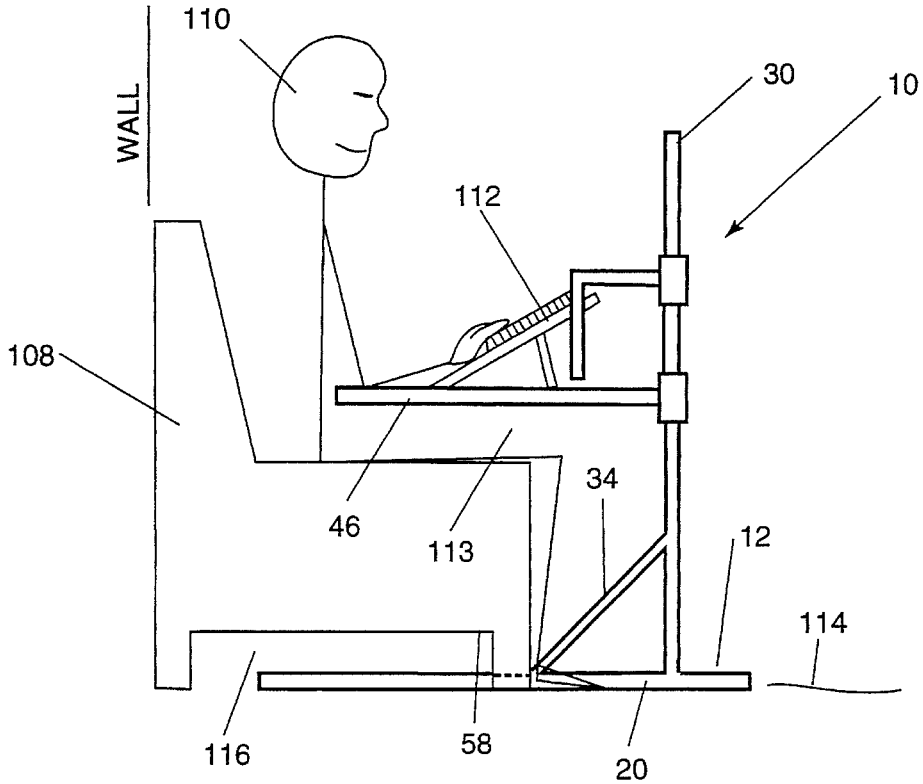

Referring now to FIGS. 2*a* and *b* there is shown generally at 10 the first embodiment of the present invention shown in FIG. 1 as it cooperates with workpiece 108 which is, in this instance, a chair. User 110 sits on chair 108. Tray 112 (FIG. 2*a*) rests on rack arms 46 and 46 (not shown). In FIG. 2*b*, tray 112 is tilted upward on tray support 113 for reading purposes. The underside 58 of workpiece 108 and ground 114 defines open space 116. Rear bar 22 (not shown) and the rearmost segments of side bars 18 (not shown) and 20 of base 12 penetrate into space 116 until braces 32 (not shown) and 34 contact underside 58. This enables the user 110 to reach up and out to pull against first upright 28 (not shown) and second upright 30 to pull user 110 up. Elongated base 12, and braces 32, 34 prevent device 10 from tipping or sliding toward user 110.

Figure 3A:
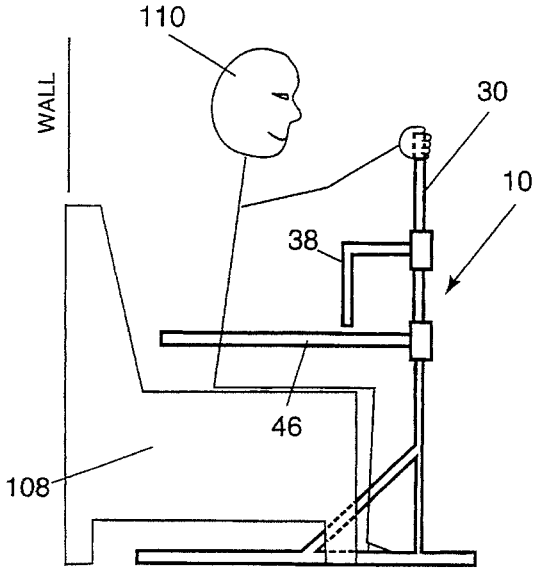
FIGS. 3*a, b, c* and *d* are a sequence of side views of the chair riser/walker embodiment of FIG. 1 showing the user rising from a chair.
Figure 3B:
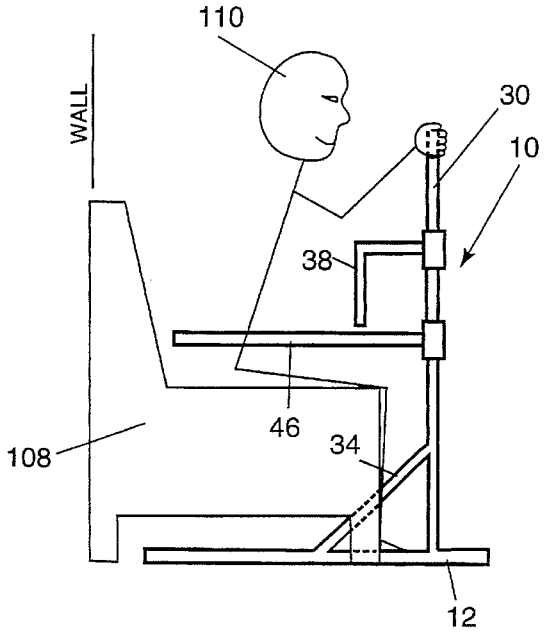
Figure 3C:
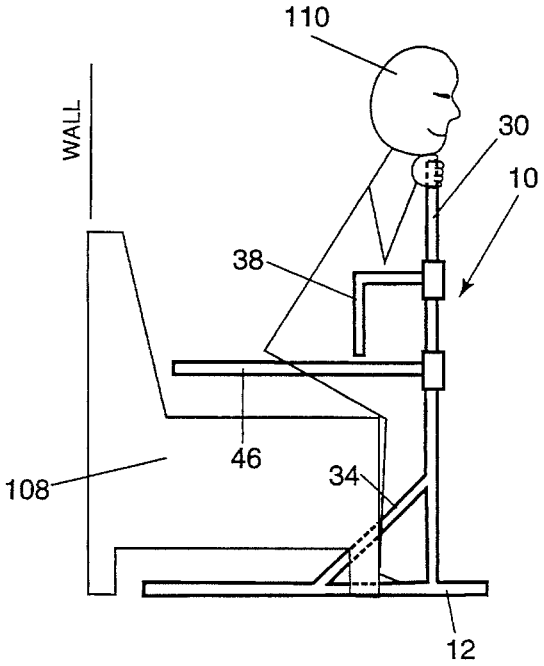
Figure 3D:
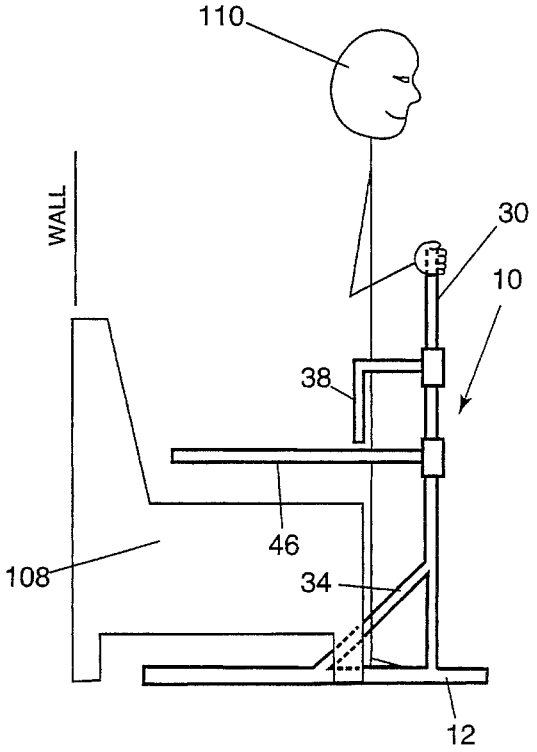

FIGS. 3*a, b, c* and *d* show a user 110 using the device of the first embodiment of FIG. 1 and rising from chair/workpiece 108 by pulling on uprights 28 (not shown) and 30 instead of having to push up as is done with prior art devices. As stated above, braces 32, 34 (not shown) contact underside 58 of workpiece 108 whereas base 12 creates a moment arm sufficient to prevent device 10 from tipping over.

Figure 4A:
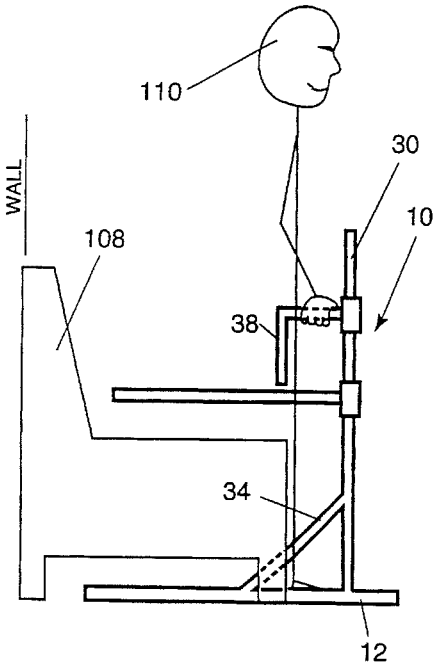
FIGS. 4*a, b, c* and *d* are a sequence of side views of chair riser/walker embodiment of FIG. 1 being used as a walker.
Figure 4B:
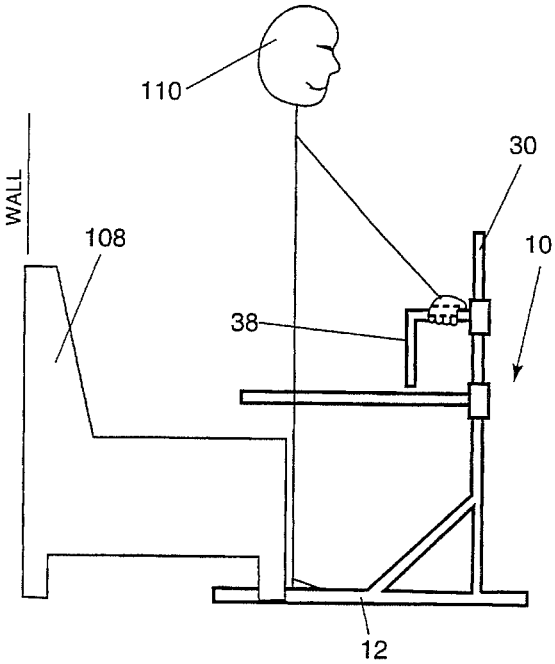
Figure 4C:
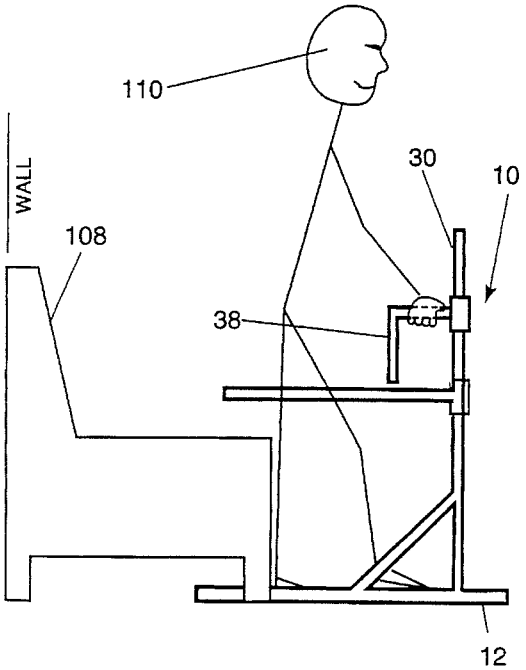
Figure 4D:
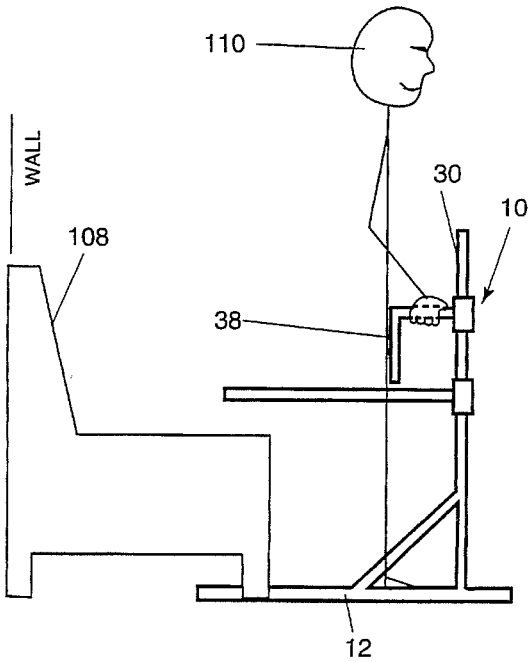

FIGS. 4*a, b, c* and *d* show the embodiment of FIG. 1 being used as a walker after the user rises from a seated position. As can be seen in comparing FIG. 3*d* with FIG. 4*a*, the user 110 moves his hands from uprights 28 and 30 to handles 36 and 38 which preferably have been vertically adjusted to suit the particular height and arm length of the user. The user then slides the device forward and steps within the boundaries of base 12.

Figure 5B:
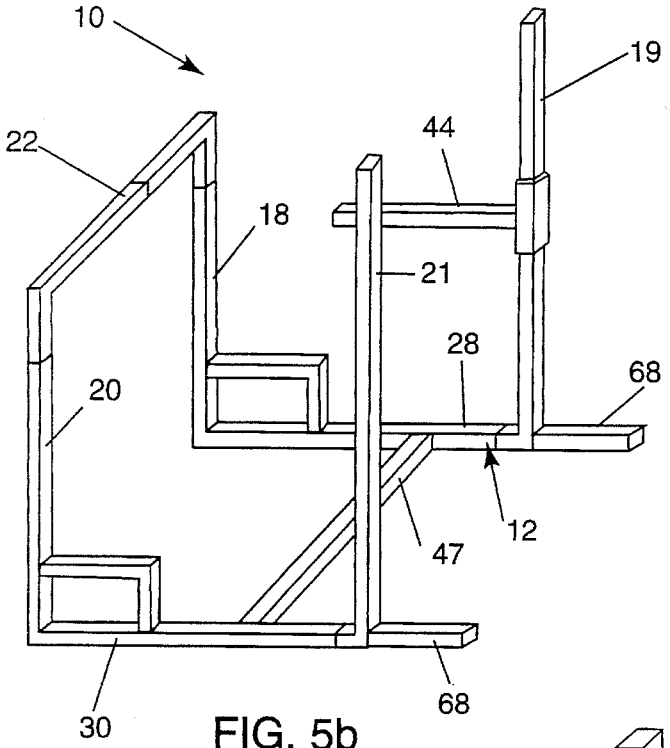
FIG. 5*a* and *b* are perspective views of second embodiment of the present invention which can be used for rising from a chair, bed, or commode, and as a walker.
Figure 5A:
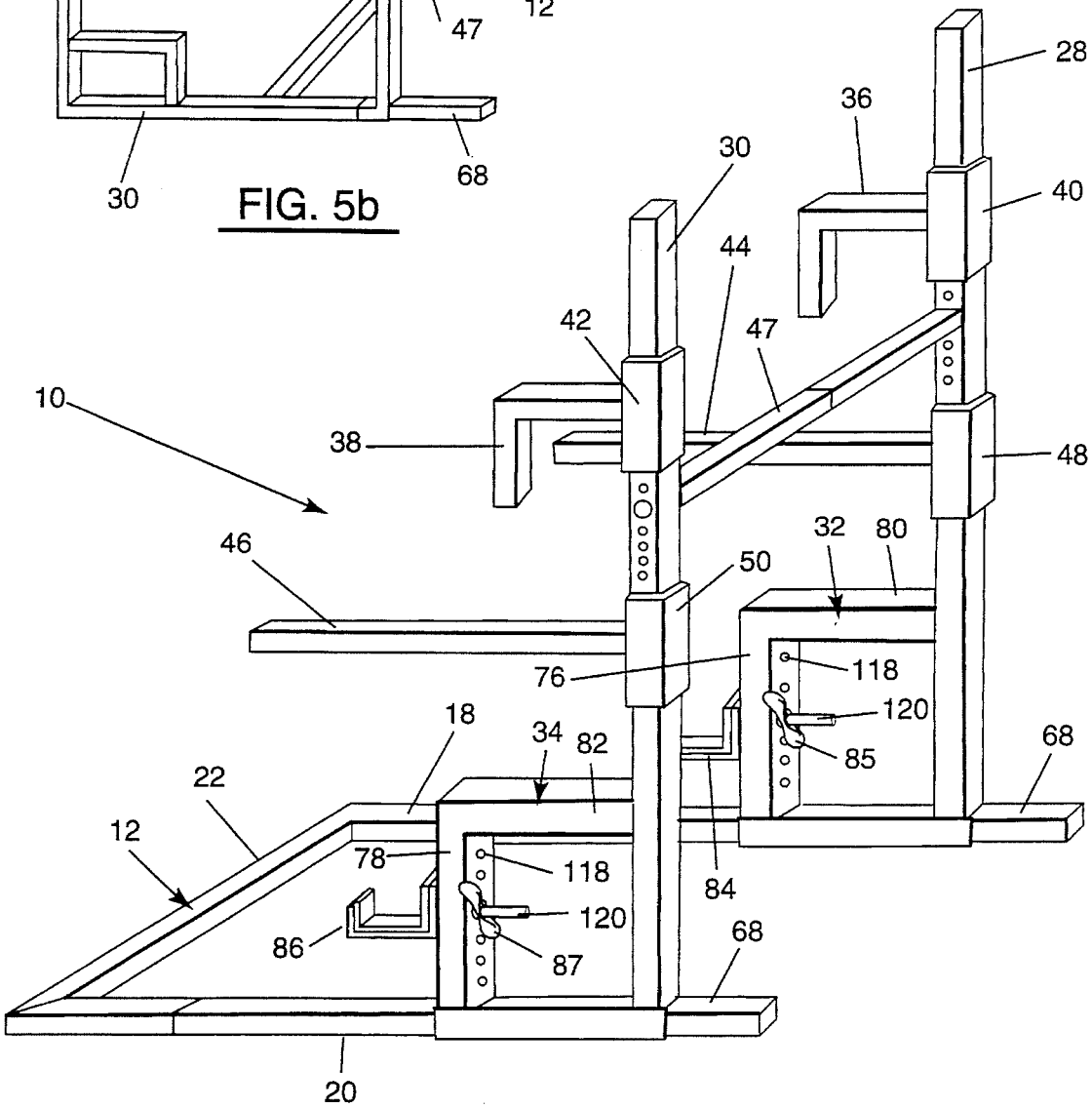

Referring now to FIG. 5*a* there is shown generally at 10 a second embodiment of the mobility assist device which can be used as an assist in rising from a chair, commode, or bed, and as a walker. This embodiment also has base 12, which includes rear floor bar 22, and side floor bars 18 and 20. First upright 28 and second upright 30 attached respectively to side bars 18 and 20, defining balance segments 68. This embodiment also has handles 36, 38 attached respectively to sleeves 40, 42 which are adjustable as in the first embodiment, and which receive respectively uprights 28, 30. Rack arms 44, 46 attached to sleeves 48, 50 received by uprights 28, 30 respectively. Removable crossbar 47 is used when the device 10 of this embodiment is used with a commode as shown in FIG. 5*b*.

In this embodiment, leverage braces 32 and 34 are not angled but are defined by vertical members 76 and 78 attached to and extending vertically from side bars 18 and 20, and horizontal members 80 and 82 attached to and extending horizontally from uprights 28 and 30. Attached to the rearward facing surfaces of vertical members 76 and 78 are u-shaped adjustable bed frame hooks 84 and 86. Hooks 84 and 86 are attached by wing nuts 85 and 87 secured to screws 120. One of multiple holes 118 through vertical members 76 and 78 receive each screw 120. This enables brackets 84 and 86 to be adjusted up and down.

FIG. 5*b* shows the device 10 of FIG. 5*a* adapted for use in assisting a user in rising from a commode (as shown generally with respect to another embodiment in FIG. 9). The device 10 has been rotated 90 degrees such that side bars 18 and 20 now rise vertically from uprights 28 and 30, which now contact the floor. Vertically positioned side bars 18 and 20 serve as a means of obtaining leverage against a wall behind a commode (see FIG. 9*a*). Handles 36 and 38 are L-shaped and can be removed. Uprights 28 and 30 are adjusted to align with the ends of side bars 18 and 20. Additional front vertical arms 19 and 21 slide on uprights 28 and 30 respectively and serve as the grasping means for the user to pull out and up from a seated position. A single rack arm 44 is attached to vertical arm 19 or 21, whichever is closest to a side wall proximate to the commode. In this configuration, rack arm 44 can be used as an arm rest. Hooks 84 and 86 are removed for this application.

Figure 6A:
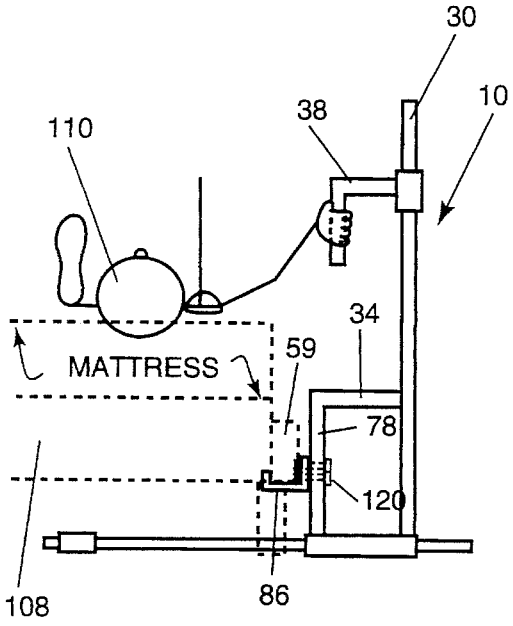
FIGS. 6*a, b, c* and *d* are a sequence of side views of the chair/bed/commode riser/walker embodiment of FIG. 5 showing the user rising from a reclining and seated position on a bed.
Figure 6B:
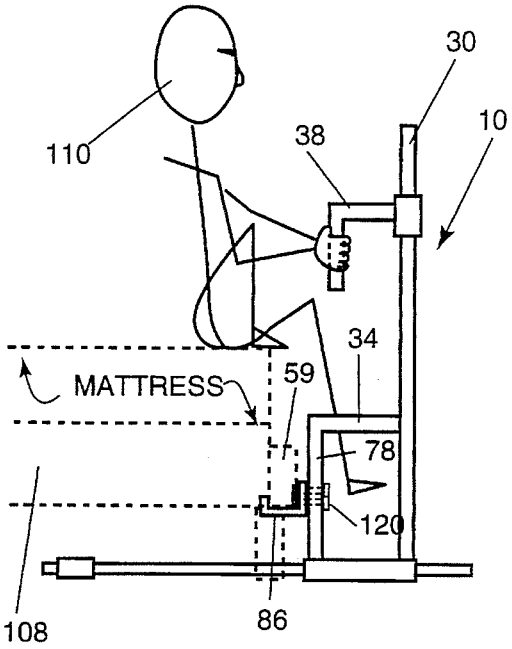
Figure 6C:
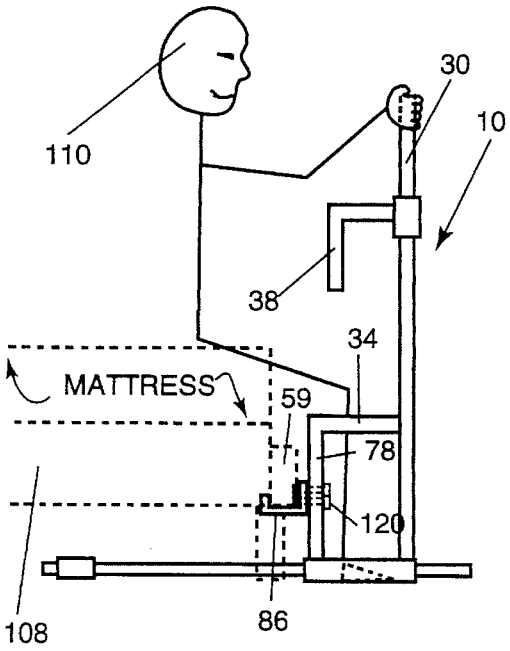
Figure 6D:
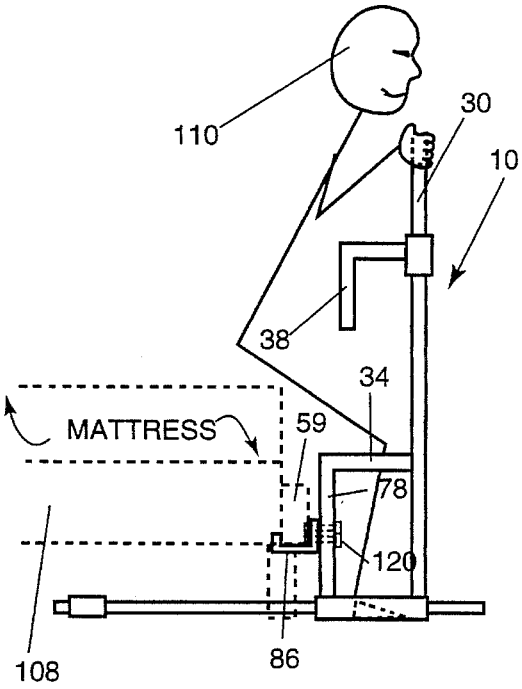

FIGS. 6*a*, *b*, *c* and *d* show the second embodiment of FIGS. 5*a* and *b* used as in assisting the user from a reclining then seated position on workpiece 108 which is, in this instance, a bed. Hooks 84 and 86 engage the underside of frame 59 of bed or workpiece 108 whereas the rearward facing surfaces of vertical members 76 and 78 of braces 32 and 34 contact the vertical surface of frame 59. The combination of hooks 84 and 86 and moment arm created by base 12 allows user 110 to rise by reaching up and out, pulling against uprights 28 and 30. Further, vertical faces 76 and 78 contact workpiece 108 to provide additional leverage. User 110 can then disengage hooks 84, 86 and use device 10 as walker. Casters 60, 62, 64, 66 as shown in FIG. 1 can be added to this second embodiment of device 10. As can best be seen in FIGS. 6*a* and *b*, handles 36 and 38 can be used by a reclining user to attain a seated position prior to rising from the bed workpiece 108.

Figure 7:
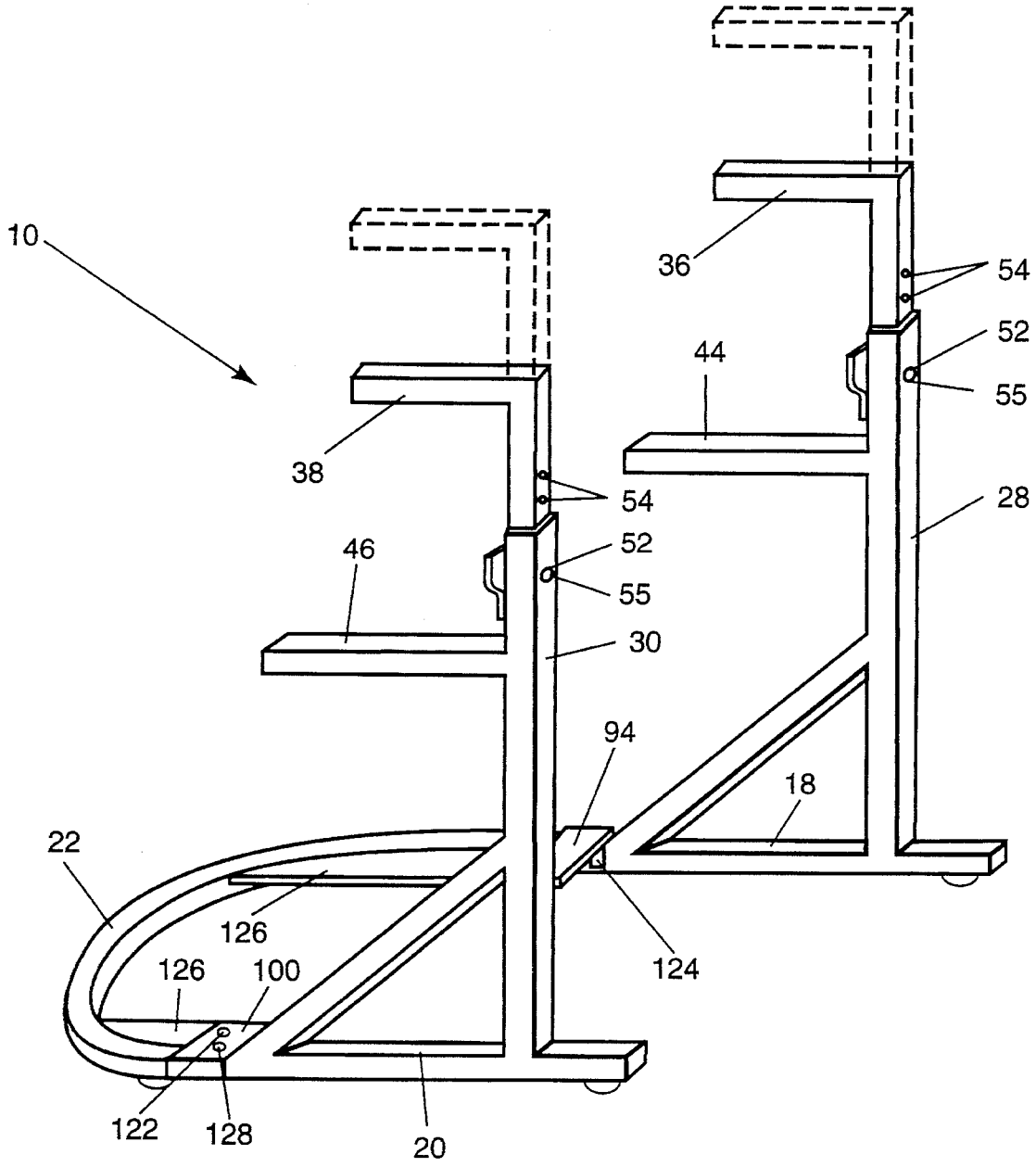
FIG. 7 is a perspective view of a third, folding embodiment of the present invention usable for rising from a chair and as a walker.

Referring now to FIG. 7, there is shown generally at 10 a third embodiment of the present invention which is usable as a walker and means for rising from a chair and which can be folded. Handles 36, 38 are L-shaped and slidably received by uprights 28, 30. This provides telescoping action between handles 36, 38 and uprights 28, 30 respectively. In this embodiment, holes 54 are placed in handles 36, 38 whereas holes 55 are placed in uprights 28, 30. Screw 52 passes through holes 55 and into holes 54. Rack arms 44, 46 are attached directly to uprights 28, 30 respectively. Base 12 includes side floor bars 18 and 20 joined by first hinge 94 and second hinge 100 to semicircular rear floor bar 22. In this embodiment, hinges 94 and 100 are defined by first pin 122 which can be removed from brackets 124 and 126 to allow rotation about second pin 128. This embodiment allows uprights 28, 30 be pivoted about second pin 128 toward rear arm 22. This pivoting allows device 10 to take up less room and allows ease of storage and moving. In this embodiment, base 12 provides user with leverage against floor 130 and leverage braces 32, 34 provide user with leverage against a chair workpiece 108 as in FIG. 3. Rear floor bar 22 can also be straight rather than semi-circular and may provide better leverage against the floor in such a configuration.

Figure 8:
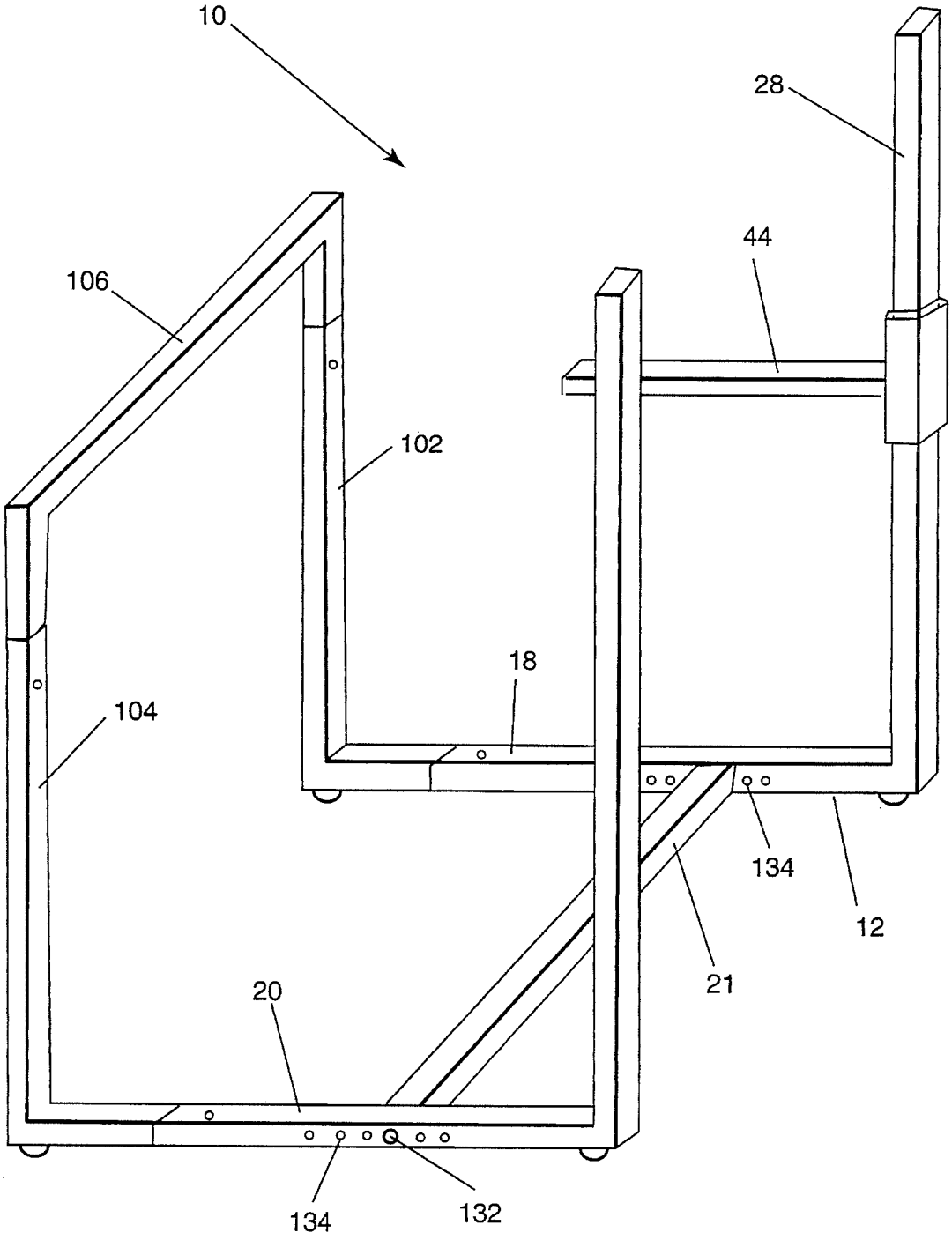
FIG. 8 is a perspective view of fourth embodiment of the present invention usable for rising from a commode.
Figure 9A:
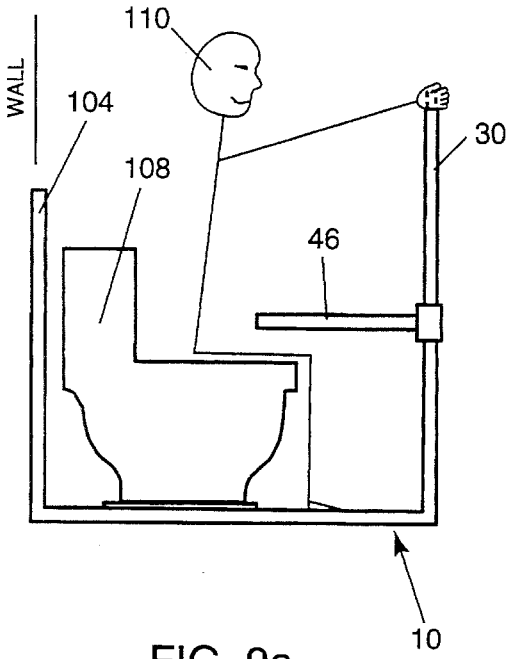
FIGS. 9*a, b, c* and *d* are a sequence of side views of the fourth embodiment of FIG. 8 showing the user rising from a commode.
Figure 9B:
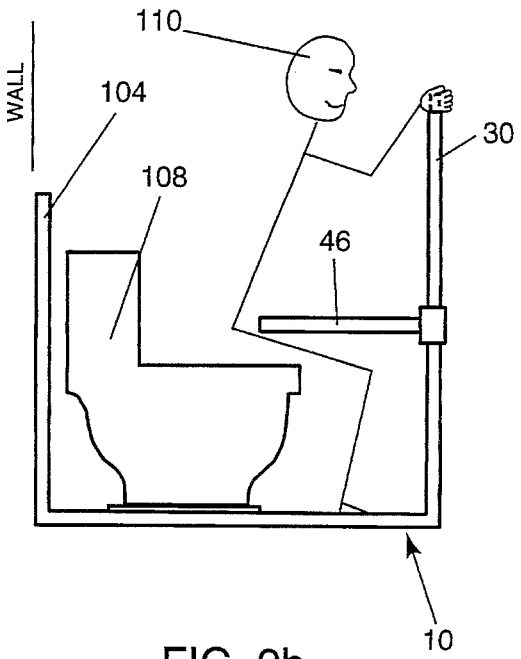
Figure 9C:
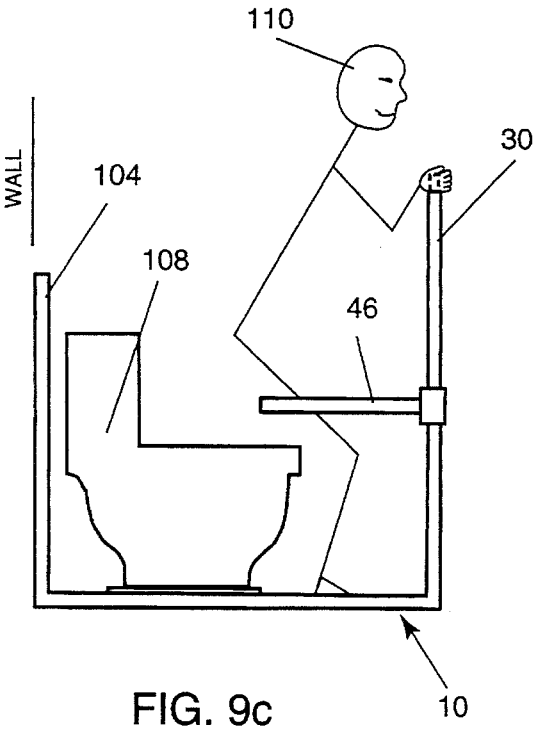
Figure 9D:
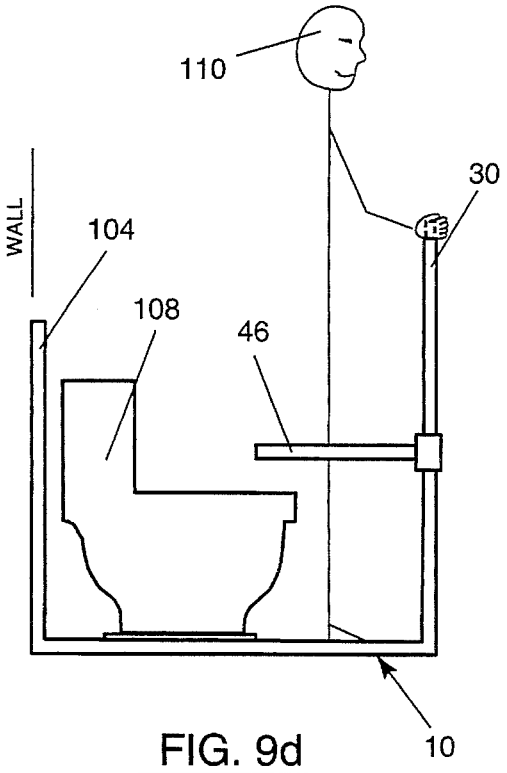

Referring now to FIG. 8 there is shown generally at 10 a fourth embodiment of the present invention which can be used as a means of rising from a commode. In this embodiment, base 12 has side floor bars 18 and 20 joined by crosspiece 21. Crosspiece 21 can be adjusted along side bars 18 and 20, by placement of screw 132 into holes 134 which are received in holes (not shown) in crosspiece 21. This embodiment of device 10 also has first upright 28 and second upright 30. This embodiment also has rear uprights 102 and 104 attached to the ends of side bars 18 and 20.

Connecting the tops of uprights 102 and 104 is leverage bracket 106. Single arm 44 is slidably attached to either upright 28 or 30, whichever is closest to a side wall, and can be used for arm or hand support. In this particular embodiment, upright 102, crosspiece 106 and upright 104 pass over and around the commode.

Referring now to FIG. 9 there is shown generally at 10 the fourth embodiment of FIG. 8. Workpiece 108, in this embodiment is a commode. User 110 sitting on toilet 108 can pull on uprights 28 and 30 against base 12 to provide sufficient leverage to sit up. Upright 102, crosspiece 106 and upright 104 allows user to pull device 10 against wall for greater leverage. Alignment of third upright 102, third crosspiece 106 and fourth upright 104 allows user to walk away from workpiece 108 with device 10. Casters 60, 62, 64, and 66 can be placed on underside 70 of base 12. In this embodiment, base 12 provides user with leverage against floor 124 and uprights 102, 104 provide user with leverage against wall 132. Uprights 28, 30 provide user 120 with the ability to pull up and toward uprights 28, 30 instead of merely pushing up.

In each embodiment, a preferred height for uprights 28 and 30 is approximately 44 inches. Bed frame hooks 84 and 86 are approximately 3 inches long and 1 to 2 inches high and are mounted so that they are adjustable along vertical members 76 and 78 up to 15 inches off the floor. Horizontal members 80 and 82 are approximately 9 inches long. Side bars 18 and 20 are nominally between 37 inches and 44 inches long. Handles 36 and 38 are preferably 6 inches in the horizontal plane and 8 inches in the vertical plane approximately. Rear floor bar 22 is approximately 26 inches long.

Angled leverage braces 32 and 34 preferably form right triangles with side bars 18 and 20 and uprights 28 and 30, having both a base and vertical length of approximately 13 inches.

Figure 10A:
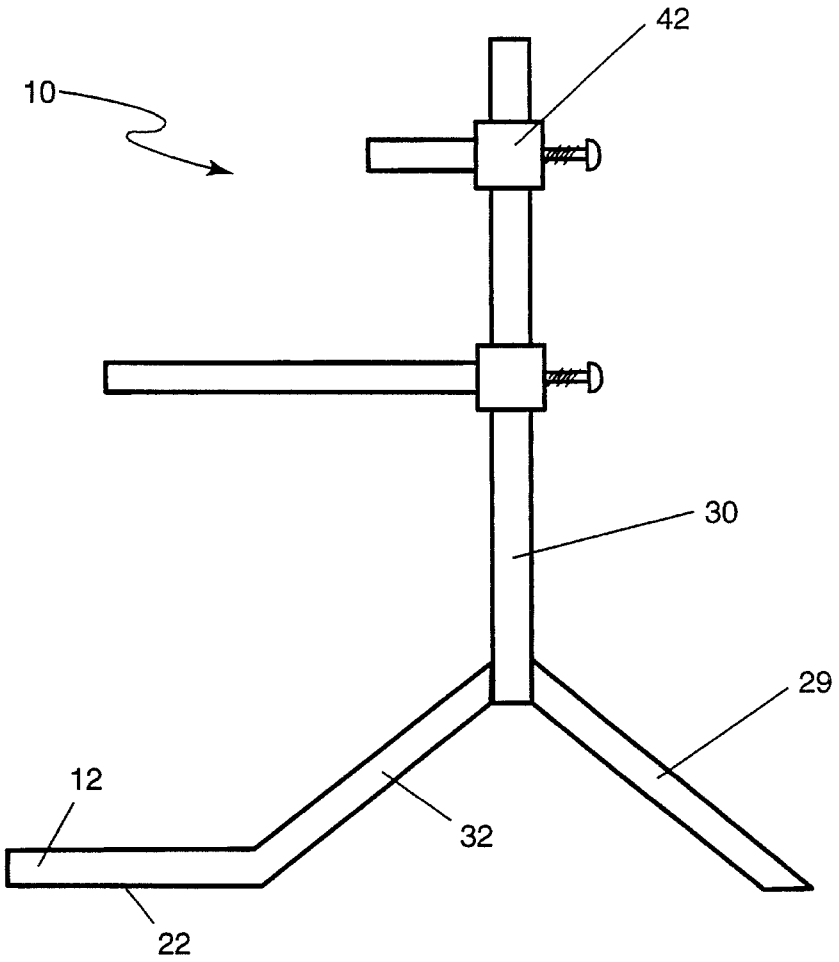
FIG. 10*a* is a side view of another embodiment of the mobility assist device of the present invention.
Figure 10B:
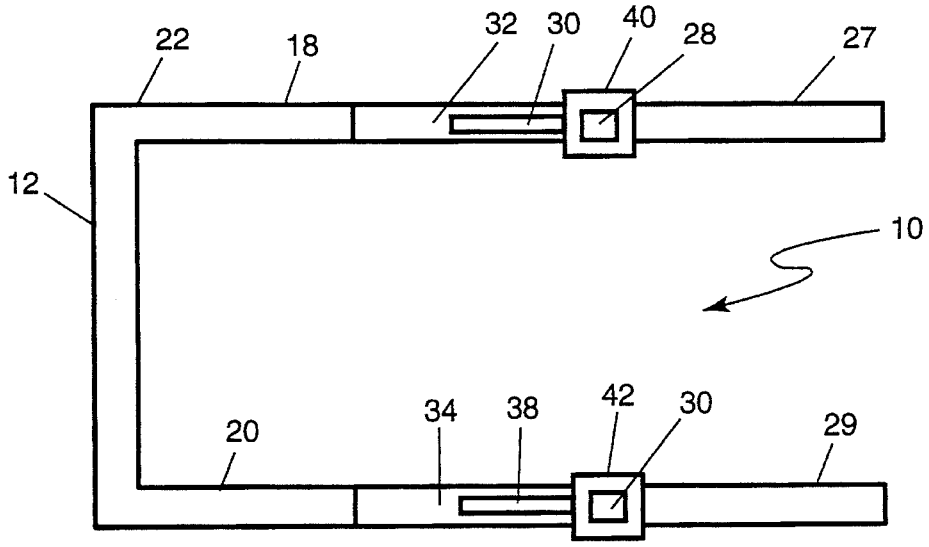
FIG. 10*b* is a plan view of another embodiment of the mobility assist device of the present invention.

Referring now to FIGS. 10*a* and *b*, there is shown generally at 10 the preferred embodiment of the mobility assist device which can be used both for rising from a chair or similar workpiece, and as a walker. The device includes a base 12, which has rear floor bar 22 joining parallel side floor bars 18 and 20. Base 12 also includes front legs 27 and 29. Between front legs 27, 29 and floor bars 18, 20, there is placed clearance 23, 25, respectively. Casters (60, 62, 64, and 66 in FIG. 1) can attach to the underside of base 12.

Attached to and extending vertically from side bars 18 and 20 are first upright 28 and second upright 30. Angled leverage braces 32 and 34 connect first upright 28 and second upright 30 to side bars 18 and 20, respectively, and serve as a means for obtaining secure leverage against the floor and a stationary workpiece (108 in FIGS. 3–4), as well as assuring proper spacing between the device 10 and the workpiece. Front legs 27, 29 then attach respectively to leverage braces 32 and 34 respectively.

The device 10 also includes adjustable means for the user to grasp the device and walk from a standing position in either direction. These means include handles 36 and 38 which are attached to sleeves 40 and 42. First sleeve 40 slidably receives first upright 28 and second sleeve 42 receives second upright 30. Sleeves 40, 42 have holes (54*a* and 54*b* as shown in FIG. 1) and uprights 28, 30 have holes (55 as shown in FIG. 1). Holes (54*a*, 54*b* and 55 as shown in FIG. 1) receive set screws (52 as shown in FIG. 1) which releasably hold sleeves 40, 42 in place. Preferably, the position of sleeves 40 and 42 along uprights 28 and 30 is adjusted so that the user may reach outwardly and above handles 36 and 38 along uprights 28 and 30 and use the uprights as a means for pulling from a seated position.

Device 10 also includes adjustable the tray rack arms (44 and 46 as shown in FIG. 1) attached to sleeves 48 and 50 respectively. Sleeves 48, 50 receive uprights 28, 30 respectively, and are attached to uprights 28, 30 respectively by set screws (52 in FIG. 1) which pass through holes (54*c* and *d* in FIG. 1) into holes (55 in FIG. 1).

Figure 11A:
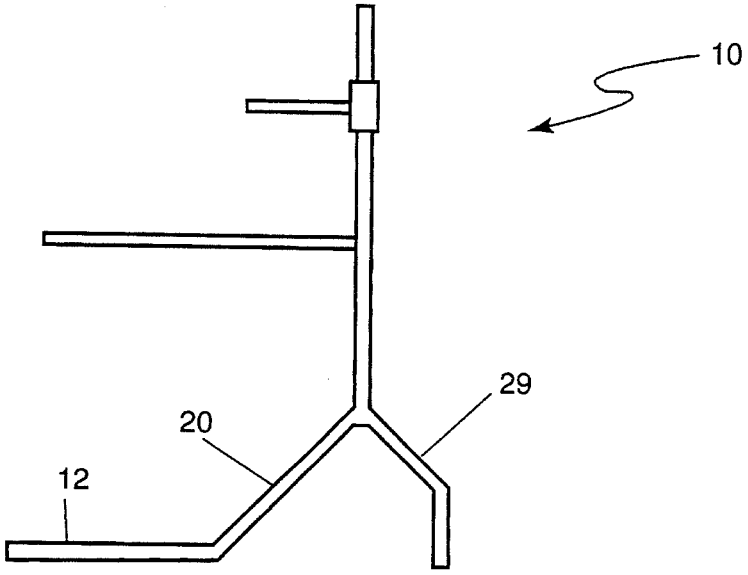
FIG. 11*a* is a side view of the preferred embodiment of the mobility assist device of the present invention.

Referring now to FIGS. 11*a* and *b*, there is shown generally at 10 the another embodiment of the mobility assist device which can be used both for rising from a chair or similar workpiece, and as a walker. The device includes a base 12, which has rear floor bar 22 joining parallel side floor bars 18 and 20. In this embodiment, bars 18 and 20 slidably receive rear floor bar 22 which allows device 10 to be collapsed and moved. Base 12 also includes front legs 27, 29 which are bent at an obtuse angle. Between front legs 27, 29 and floor bars 18, 20, there is placed clearance 23, 25, respectively. Casters (60, 62, 64, and 66 in FIG. 1) can attach to the underside of base 12.

Attached to and extending vertically from side bars 18 and 20 are first upright 28 and second upright 30. Angled leverage braces 32 and 34 connect first upright 28 and second upright 30 to side bars 18 and 20, respectively, and serve as a means for obtaining secure leverage against the floor and a stationary workpiece (108 in FIGS. 3–4), as well as assuring proper spacing between the device 10 and the workpiece. Front legs 27, 29 then attach respectively to leverage braces 32 and 34 respectively.

The device 10 also includes adjustable means for the user to grasp the device and walk from a standing position shown in the other figures.

Figure 11B:
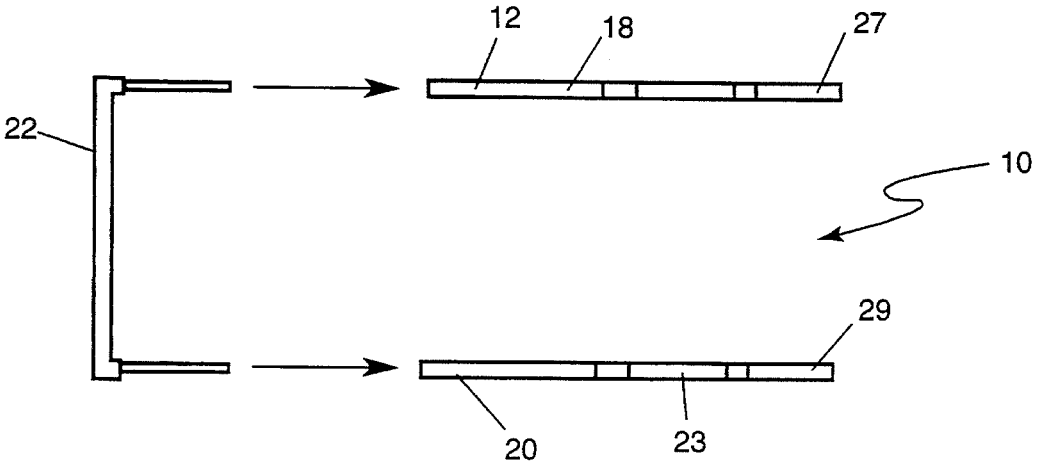
FIG. 11*b* is a plan view of the preferred embodiment of the mobility assist device of the present invention.
Figure 11C:
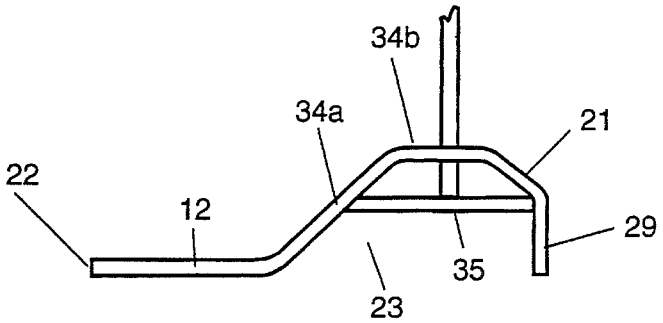
FIG. 11*c* is a side view of the preferred embodiment of the mobility assist device of the present invention.

Referring now to FIG. 11*c*, there is shown generally at 10 a variation of the embodiment shown in FIGS. 11*a* and *b*. The device includes a base 12, which has rear floor bar 22 joining parallel side floor bars (18 as shown in FIG. 11*b*) and 20. Base 12 also includes front legs 27 (optically disposed but a mirror image of 29) and 29 which are bent at an obtuse angle. Between front legs 27, 29 and floor bars 18, 20, there is placed clearance 23, 25, respectively. Casters (60, 62, 64, and 66 in FIG. 1) can attach to the underside of base 12. Leverage braces (optically disposed but a mirror image of 34) and 34 connect first upright (optically disposed but a mirror image of 30) and second upright 30 to side bars 20, respectively, and serve as a means for obtaining secure leverage against the floor and a stationary workpiece (108 in FIGS. 3–4), as well as assuring proper spacing between the device 10 and the workpiece. Leverage braces 34 as shown in FIG. 11*c* are bent such that first section 34*a* is substantially at an acute angle from horizontal and section 34*b* is substantially horizontal. Cross member 35 joins brace 34 to leg 29. Further, in this embodiment, cross member 35 also attaches to uprights. In the preferred embodiment, base 12 of this embodiment is continuous from side bar through support brace and through leg.

Thus, although there have been described particular embodiments of the present invention of a new and useful device for assisting an individual in rising from a workpiece, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A portable device for assisting a user in rising from a workpiece stationary on a floor, said device comprising:

a. first and second uprights extending vertically from and positioned horizontally along a base for allowing said user to grasp said uprights and pull outwardly and upwardly from a seated positioned on said workpiece;

b. said base adapted to allow leverage against said floor, said base having a front end and a rear end and a clearance between said front end and said rear end;

c. braces attached to said base and attached to said uprights, said braces positioned vertically along said uprights and horizontally along said base whereby when said device is positioned proximate to a workpiece for use, said braces contact a portion of the workpiece to provide leverage against said workpiece while said user is rising from said workpiece and to space said uprights away from the user whereby the arms of the user must be extended to grasp said uprights; and d. legs attached to said braces such that said clearance occurs between said base and said legs.

2. The device of claim 1 wherein said base comprises first and second side floor bars joined by a rear floor bar.

3. The device of claim 1 wherein said brace is bent.

4. The device of claim 1 wherein said legs are bent.

5. The device of claim 1 wherein said braces each comprise a first section and a second section wherein said first section is not in straight alignment with said second section.

6. The device of claim 1 wherein said braces comprises a bracket for releasably engaging said workpiece.

7. The device of claim 1 wherein said braces and said legs are unitary pieces.

8. A portable mobility assist device comprising:

a. a base, said base adapted to function as a leverage brace against a wall when said device is used to assist a user in rising from a commode to a standing position, said base having a front end and a rear end and a clearance between said front end and said rear end;

b. brace means attached to said base for obtaining leverage against a chair or bed, while said user of said device rises from said chair or bed from a seated to a standing position while grasping said device;

c. adjustable uprights attached to said base for said user to grasp while rising, said uprights adapted for allowing said user to reach and pull outwardly and up while rising;

d. adjustable L-shaped handles attached to said uprights for the user to grasp while standing and using said device as an assist in walking, said handle means further adapted for grasping while said user is pulling up from a reclining position on a bed to a seated position;

e. adjustable hook means attached said brace means for securing said device to a frame of said bed and obtaining leverage from said bed frame while said user is rising from a seated position; and f. removable arms attached to said uprights for supporting an adjustable and removable reading and eating tray.

9. A portable device for assisting a user in rising from a workpiece stationary on a floor, said device comprising:

a. means for allowing said user to grasp said device and pull outwardly and upwardly from a seated position on said workpiece;

b. a base attached to said grasping and pulling means to allow leverage against said floor such that said base having a front end and a rear end and a clearance between said front end and said rear end;

c. means attached to said base means to provide leverage against said workpiece while said user is rising from said workpiece; and d. said base having first and second side floor bars joined by a rear floor bar.

10. The device of claim 9 wherein said grasping and pulling means comprises:

a. a first upright attached to said first side floor bar away from said rear floor bar, said first upright substantially perpendicular to said base; and b. a second upright attached to said second floor bar away from said rear floor bar, said second upright substantially perpendicular to said base.

11. The device of claim 10 wherein said means attached to said base to provide leverage against said workpiece comprises:

a. a first brace joined to said first side floor bar and to said first upright; and b. a second brace joined to said second side floor bar and to said second upright.

12. The device of claim 11 further comprising handle means for allowing said user to grasp and use said device for walking with said device along said floor.

13. The device of claim 12 wherein said handle means comprises:

a. a first handle slidably attached to said first upright;

b. a second handle slidably attached to said second upright; and c. each of said handles is movable with respect to said respective upright.

14. The device of claim 13 further comprising:

a. a first sleeve receiving and releasably attaching to said first upright, said first sleeve attached to said first handle; and b. a second sleeve receiving and releasably attaching to said second upright, said second sleeve attached to said second handle.

15. The device of claim 12 further wherein each of said braces form the hypotenuse of a right triangle with said corresponding side floor bar and said corresponding upright such that said braces contact the a lower side of said workpiece.

16. The device of claim 14 further comprising means to receive a tray.

17. The device of claim 16 wherein said means to receive a tray comprises:

a. a first rack arm in substantial parallel alignment with said first side floor bar, said first rack arm slidably attached to said first upright between said first handle and said first brace; and b. a second rack arm in substantial parallel alignment with said second floor bar, said second rack arm slidably attached to said second upright between said second handle and said second brace.

18. The device of claim 17 further comprising means to raise and lower said means to receive a tray.

* * * * *